United States Patent [19]

Fotland et al.

[11] Patent Number: 4,518,468

[45] Date of Patent: May 21, 1985

[54] PROCESS FOR MAKING ELECTROSTATIC IMAGING SURFACE

[75] Inventors: Richard A. Fotland, Holliston; Leo A. Beaudet, Milford, both of Mass.

[73] Assignee: Dennison Manufacturing Company, Framingham, Mass.

[21] Appl. No.: 468,435

[22] Filed: Feb. 22, 1983

[51] Int. Cl.[3] ..... C25D 11/06

[52] U.S. Cl. ..... 204/38.3; 204/38.7; 427/334; 430/104

[58] Field of Search ..... 204/6, 17, 25, 38 A, 204/38 E; 29/110; D16/30, 32; 427/144, 295, 298, 416, 334; 430/104

[56] References Cited

U.S. PATENT DOCUMENTS

| | | | |
|---|---|---|---|
| 2,022,798 | 12/1935 | Bengston | 29/148 |
| 2,698,262 | 12/1954 | Balmas | 117/35 |
| 3,317,411 | 5/1967 | Letendre | 204/29 |
| 3,615,405 | 10/1971 | Shebanow | 96/1.5 |
| 3,782,997 | 1/1974 | Daly et al. | 117/49 |
| 3,945,899 | 3/1976 | Nikaido et al. | 204/181 |
| 4,007,706 | 2/1977 | Arvidsson | 118/50 |
| 4,195,927 | 4/1980 | Fotland et al. | 355/3 TE |
| 4,311,735 | 1/1982 | Young | 427/295 |

FOREIGN PATENT DOCUMENTS 1547801 6/1979 United Kingdom .

*Primary Examiner*—Howard S. Williams
*Assistant Examiner*—Terryence Chapman
*Attorney, Agent, or Firm*—Arthur B. Moore; Barry D. Josephs; George E. Kersey

[57] ABSTRACT

Dielectric sealing of porous anodized aluminum, in which moisture in the pores of the oxide coating formed by hardcoat anodizing is removed, and the porous anodized surface then impregnated with a dielectric wax. Suitable wax sealants include Carnauba and Montan waxes. The anodized member is preliminarily heated to a temperature in the range 120°-180° C. in order to drive off moisture and other substances from the pores. This heating process may be continued for the purposes of impregnating the pores with the wax sealant, which is applied as a hot melt. Alternatively, the preliminary dehydration is achieved simply by heating the member to the impregnating temperature, with no separate dehydration stage. Any excess material remaining on the member's surface is removed. The resulting product has excellent resistivity and dielectric properties, and maintains these properties at elevated humidities. After removing material from the member's surface, the member may be polished to a better than 20 microinch finish, achieving favorable toner release characteristics where the member is used for pressure transfer of a toner image.

11 Claims, 10 Drawing Figures

PROCESS FOR MAKING ELECTROSTATIC IMAGING SURFACE

BACKGROUND OF THE INVENTION

The present invention relates to the sealing of anodized aluminum and aluminum alloy structures to achieve superior dielectric properties. More particularly, the invention relates to the production of hard, abrasion resistant dielectric members and to electrostatic imaging processes and apparatus utilizing such members.

Electrostatic printers have been proposed which make use of a member commonly in the form of a cylinder and consisting of an electrically conductive core coated with a dielectric material capable of receiving a pattern of electrostatic charge from a discharge device. This device is so controlled that a selected pattern of charge can be applied to the surface of the cylinder as it passes the device. Subsequently, this pattern is toned using, for example, particulate toner supplied by a suitable feed system, and then the toned image on the cylinder is transferred at a nip with a pressure roller to a receptor medium such as a sheet of paper as the paper passes through the nip. This transfer may or may not include toner fusing depending upon the nip pressure and also, for best results, on whether or not the cylinder and roller are skewed relative to one another. Subsequently, any remaining toner is scraped off mechanically and any electrostatic charge on the cylinder is dissipated as the cylinder passes a discharge device prior to receiving another selected pattern of charge. Apparatus of this type is disclosed in commonly assigned U.S. Pat. No. 4,267,556.

In such a printer, the cylinder must satisfy a number of design criteria. Firstly, the surface should receive the desired pattern of charge accurately and without variations in electrostatic intensity within the pattern. The surface should maintain the pattern without significant dissipation before reaching the nip, and also the pattern must be dissipated by the discharge device leaving as nearly as possible no charge pattern on the cylinder. All of these criteria should be met ideally in a range of temperature and humidity variations which may be controlled within limits. Other desirable criteria relate to the mechanical requirements of the cylinder surface. The forces applied at the nip demand that the dielectric surface withstand a large distributed load which will, of course, result in some strain on the cylinder. Further, because the paper feeding into and out of the nip represents an impact loading and unloading, there are suddenly-applied local forces which the dielectric layer must resist. Also, when the cylinder and pressure roller are skewed, the paper is made to follow the pressure roller rather than the cylinder to cause sheer in the toner. The resultant relative movement between the dielectric layer and the paper could result in abrasion of the dielectric layer because the toner acts as an abrasive between the paper and the surface of the layer. The layer must withstand a mechanical scraper normally used to strip excess toner off the cylinder after the majority of the toner has been transferred to the paper. Other potential problems relate to nonuse of the machine while a load is maintained at the nip, and also to ambient temperature and moisture variations, which should have no significant lasting effect on the cylinder.

U.S. Pat. No. 4,195,927 discloses electrophotographic apparatus identical in construction to the '556 printing apparatus, except for the means for forming the latent electrostatic image on the dielectric cylinder. In the '927 apparatus, the latent electrostatic image is formed on a photoreceptor by conventional electrophotographic techniques, and transferred by TESI to the dielectric cylinder. The criteria for the '927 dielectric cylinder match those discussed above.

Hardcoat anodization of aluminum and aluminum alloys is an electrolytic process which is used to produce thick oxide coatings with substantial hardness. Such coatings are to be distinguished from natural films of oxide which are normally present on aluminum surfaces, and from thin, electrolytically formed barrier coatings. The anodization of aluminum to form thick dielectric coatings takes place in an electrolytic bath containing an acid, such as sulfuric or oxalic acid, in which aluminum oxide is slightly soluble. The production techniques, properties, and applications of these aluminum oxide coatings are described in detail in *The Surface Treatment and Finishing of Aluminum and Its Alloys* by S. Wernick and R. Pinner, fourth edition, 1972, published by Robert Draper Ltd., Paddington, England (chapter IX page 563). Such coatings are extremely hard and mechanically superior to uncoated aluminum. However, the coatings contain pores in the form of fine tubes with a porosity on the order of $10^{10}$ to $10^{12}$ pores per square inch. Typical porosities range from 10 to 30 percent by volume. These pores extend through the coating to a very thin barrier layer of aluminum oxide, typically 300 to 800 Angstroms.

For improved mechanical properties as well as to prevent staining, it is customary practice to seal the pores. One standard sealing technique involves partially hydrating the oxide through immersion in boiling water, usually containing certain nickel salts, which form an expanded boehmite structure at the mouths of the pores. Oxide sealing in this manner will not support an electrostatic charge due to the ionic conductivity of moisture trapped in the pores.

Another method of sealing an anodized aluminum member is disclosed by Quaintance in U.S. Pat. No. 3,715,211. This is a method of cold sealing by the photopolymerization of an organic liquid applied to the anodized surface.

U.S. Pat. No. 3,615,405 discloses a method of fabricating an electrophotographic oxide surface by means of impregnating the porous oxide surface of an aluminum article with an "imaging material." The process creates a member with direct contact between the imaging material and the conductive substrate over which the porous oxide layer is formed. This patent does not disclose a step of dehydrating the oxide pores prior to impregnation with an imaging material (the article is placed in a vacuum oven only after coating with an impregnant material). As such, there is a likelihood of trapped moisture, which would be deleterious to the dielectric properties of the impregnated anodic layer. In order to provide discharge in radiation struck areas, U.S. Pat. No. 3,615,405 requires contact of the "electrographic imaging material" with the conducting substrate. In the present invention, the sealing material contacts an insulating barrier layer.

These foregoing references cannot be used for the processing of an aluminum cylinder for use in electrostatic imaging with pressure fusing and transfer as discussed above and in U.S. Pat. No. 3,662,395. Table 2 of that patent indicates that a porous aluminum oxide surface sealed with teflon is not satisfactory for electrostatic imaging due to the low breakdown voltage and low pore insulation resistance of the aluminum oxide surface. The organic resin sealant fails to achieve the necessary high abrasion resistance and coating hardness.

A drum coated with an insulating film capable of supporting an electrostatic charge is disclosed in U.S. Pat. No. 3,907,560. The dielectric surface is a barrier layer aluminum oxide film since it is stated that the porous anodized aluminum oxide layer functions as a conductor rather than a dielectric. Although a barrier layer anodized aluminum film is a good insulator, being non-porous, the maximum thickness of barrier layer films is restricted to the region of at most ½ to 1 microns. At this thickness, the maximum voltage the layer will support is limited and the surface is not hard in a conventional sense since any localized strains are transmitted through the thin film with subsequent deformation of the aluminum substrate.

The limitations of the thin barrier film are overcome in U.S. Pat. Nos. 3,937,571 and 3,940,270 by the use of a duplex anodized aluminum coating. The coating is prepared by electrolytically oxidizing an aluminum surface and thereafter continuing the electrolytic oxidization under conditions which produce a barrier aluminum oxide layer. Not only does this increase the complexity of fabricating the anodized layer, but the limiting thickness is approximately 20 microns and the surface potential to which the oxide layer may be charged has a maximum of 620 volts.

Commonly assigned U.S. patent application Ser. No. 072,524, which is a continuation-in-part of application Ser. No. 822,865, now abandoned, discloses a method for forming a dielectric surface layer involving the preliminary dehydration of an anodized aluminum member followed by impregnation of surface apertures of the dehydrated member with an organic dielectric material. The preliminary dehydration may be accomplished by heating the anodized member in a vacuum or in air, or alternatively by storing it in a desicant container. This application discloses a class of impregnant materials broadly described as organic resins. The method disclosed therein has been found effective to fabricate a dielectric surface with improved resistivity, dielectric properties, and toner release properties. It has been observed, however, that the dielectric properties are deleteriously affected by elevated humidities. Because these materials are usually applied at room temperature, special measures must be taken to control the environment during impregnation to minimize the risk of dehydration. Furthermore, it can be difficult to remedy the problem of an initially uneven application of the impregnant material.

Commonly assigned U.S. patent application Ser. No. 346,346, which is a continuation-in-part of Ser. No. 164,482, which is a continuation-in-part of Ser. No. 155,354 filed June 2, 1980, discloses an improvement to the above method wherein the impregnant materials are metallic salts of fatty acids. These are typically applied to seal the anodized aluminum member while the latter is maintained at an elevated temperature above the melting point of the impregnant material. These materials provide the advantages of ease of fabrication and improved dielectric properties at high humidities, but may suffer undesirably high dielectric absorption under certain conditions (such as prolonged storage in high humidities). In other words, under unfavorable operating conditions there will be a tendency toward retention of subsurface charge in the impregnated anodic layer. During neutralization of the dielectric surface this charge will migrate to the surface providing an undesirable residual potential.

U.S. Pat. No. 3,782,997 discloses a method for treating anodized beryllium members to produce corrosion resistant dielectric surfaces. After anodizing, the beryllium members are cleaned, baked at 250° F. in a normal atmosphere, then at 200° F. in a vacuum to remove residual moisture. The article is cooled at 160° F. to seal the pores with an epoxy resin or similar material, using high pressure to facilitate impregnation. Excess material is removed by bleeding the member or rinsing it with a solvent. Finally, the member may be maintained at 212° F. for several hours to cure the impregnant material. This reference does not teach the production of a dielectric member having the surface properties required for good toner transfer under pressure. The method and product of this reference suffer some of the same disadvantages as cited above for Ser. No. 072,524.

Accordingly, it is a primary object of this invention to provide desired dielectric properties in the treatment of members of porous anodized aluminum and aluminum-based alloys. A related object is to improve the dielectric strength and increase the resistivity of such members. Another related object is the achievement of thick dielectric surface layers with a high voltage acceptance and low charge decay rates.

It is a further object of the invention to provide a treated aluminum surface that will yield essentially total pressure transfer of a toned electrostatic image to plain paper and other substrates.

Yet another object of the invention is the achievement of a surface which maintains the above properties at elevated humidities.

Still another object of the invention is that the fabrication technique be easily implementable. As a related object, the technique should allow simple remedial steps to meet the above criteria where the initial fabrication is unsuccessful.

Further objects of the invention are hardness and abrasion resistance which would allow pressure transfer and fusing of electrostatic toner, while providing an extended operating life.

It is also desirable that such surfaces permit neutralization of most or all of any residual electrostatic image, i.e. minimal dielectric absorption.

SUMMARY OF THE INVENTION

In furthering the above and additional objects, the invention provides a method of making a dielectric member and achieves hard, abrasion resistant dielectric members of particular utility in electrostatic imaging. The invention also encompasses electrostatic imaging apparatus incorporating such members, in which a toned electrostatic image is transferred and simultaneously fused to an image receptor under high pressure.

The method of manufacturing the dielectric member includes the anodizing of an aluminum or aluminum alloy member, dehydration of the anodic oxide surface layer, followed by impregnation of surface pores with a dielectric wax. The anodizing parameters are advantageously controlled to provide an oxide layer of a thickness in the range 0.25–4 mils, more preferably 0.75–1.5 mils. After completing impregnation, any excess impregnant is removed from the member's surface leaving only the material in the pores.

In the preferred embodiment, the surface is then polished to a finish better than 20 microinch rms, most preferably better than 10 microinch rms.

This process results in a member having a thick, hard, abrasion resistant dielectric surface layer. Such a member is especially well-suited to an electrostatic imaging process wherein a latent electrostatic image is formed on the dielectric surface layer, toned, and transferred to a receptor medium using high pressure. The dielectric surface layer has a resistivity greater than $10^{12}$ ohm-centimeters, and is characterized by high charge acceptance and dielectric strength. Such dielectric properties are maintained even at extremely high relative humidities. In the preferred embodiment, the member has a smooth continuous surface providing good toner release over prolonged operation. The dielectric surface is characterized by low dielectric absorption, permitting substantially complete neutralization of electrostatic images. The dielectric surfaces of the invention are durable and abrasion resistant, and may be subjected to scraping for removal of residual toner during an extremely long service life.

In the preferred embodiment of the invention, the preliminary dehydration is accomplished by heating the anodized member. The member is desirably heated to a temperature in the range from about 120° to 180° C., the preferred temperatures being around 150° to 170° C. The heated member may be maintained in a vacuum for enhanced dehydration. The processing at these elevated temperatures ensures sealing of the pores in an essentially moisture free state, without causing oxidation or other degradation of the impregnant wax.

In accordance with another aspect of the invention, the dehydrated member is impregnated with a material comprising a wax sealant from the group Carnauba yellow #1, Carnauba refined #2 and #3, and Montan wax. These waxes may be modified with resins or other additives for enhanced dielectric properties. Various paraffins and other petroleum-derived waxes, beeswax, and candelilla wax have not been found to provide comparable performance.

In the preferred embodiment of the invention, the impregnant material is applied to the anodized member while the latter is heated. Most preferably, the material is premelted and coated over the heated oxide surface. After the impregnant material thoroughly covers the heated surface, the member is maintained at the elevated temperature for a period and then allowed to cool to room temperature. The pores in the member's surface are sealed by the impregnant in a substantially moisture-free condition, resulting in a thick, hard surface with a high potential acceptance, having a resistivity in excess of $10^{12}$ ohm-centimeters and low dielectric absorption.

In accordance with still another aspect of the invention, one may remedy undesirable characteristics (as, for example, an uneven or insufficient level of impregnant) resulting from a poor initial application of the impregnant material. These may be remedied subsequently to impregnation and preferably prior to polishing simply by reheating the aluminum member.

In the preferred embodiment of the invention, the treated aluminum member takes the form of an aluminum cylinder or cylindrical sleeve for use in electrostatic imaging. The anodized and impregnated surface of the cylinder provides a dielectric surface layer, while the sublayer of the cylinder provides a conducting substrate. The invention provides a combination of a dielectric cylinder produced as set forth herein with a compliant roller to provide a nip for direct transfer of toned images from the cylinder to a receptor sheet. A latent electrostatic image is generated on the dielectric surface, such as by generation of a selected charge image with an ion emitting print device in accordance with U.S. Pat. No. 4,267,556, or by TESI transfer from a photoreceptor in accordance with U.S. Pat. No. 4,195,927. The electrostatic image is toned, and the toner image transferred and fused to a receptor sheet due to a compressive load at the nip. The rollers may be skewed for enhanced toner transfer and fusing. Means may be provided to remove residual toner and to neutralize any residual charge image.

BRIEF DESCRIPTION OF THE DRAWINGS

The above and additional aspects of the invention are illustrated in the detailed description which follows, taken in conjunction with the drawings in which:

FIG. 3 plots carnauba yellow No. 1, after polishing;

FIG. 4 plots carnauba yellow No. 2, after polishing;

FIG. 5 plots crude montan wax, after polishing;

FIG. 6 plots carnauba yellow No. 1, after polishing and prolonged moisture exposure;

FIG. 7 plots carnauba yellow No. 2, after polishing and prolonged moisture exposure;

FIG. 8 plots montan wax, after polishing and prolonged moisture exposure; and FIG. 9 plots beeswax, after polishing and prolonged moisture exposure.

DETAILED DESCRIPTION

Figure 1:
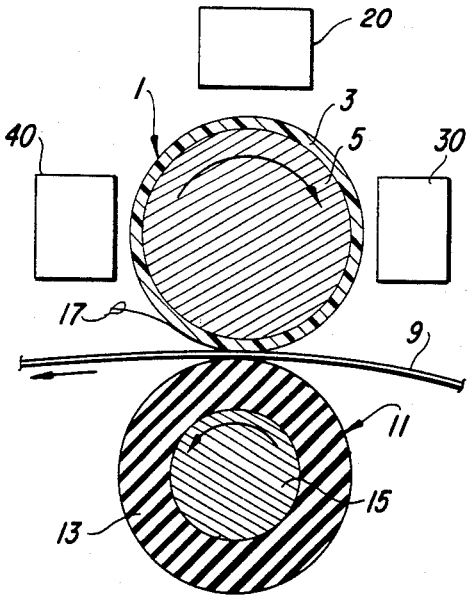
FIG. 1 is a sectional schematic view of electrostatic imaging apparatus incorporating a dielectric member fabricated in accordance with the invention.

The method of the present invention comprises a series of steps for fabricating and treating anodized aluminum members. This method results in members having dielectric surfaces particularly suited to electrostatic imaging. Such members are effective in an imaging process in which they receive an electrostatic latent image, carry the image with minimal charge decay to a toning station, and impart the toned image to a further member, using high pressure. After transfer of the toner image from the imaging member, the member may be scraped in order to remove residual toner. Finally, the member is typically treated to neutralize any remaining electrostatic image on the dielectric surface in preparation for reimaging. Preferred electrostatic printing and copying apparatus of this description is generally disclosed respectively in commonly assigned U.S. Pat. Nos. 4,267,556, and 4,195,927. A number of properties of particular concern in this utilization include charge acceptance, hardness, tensile strength, abrasion resistance, toner release characteristics, and electrostatic discharge characteristics.

The initial stage of the manufacturing process entails fabricating a member of suitable form and composition. The member may be comprised of aluminum or, advantageously, an aluminum alloy. In choosing an alloy of suitable composition, principal criteria include hardness, tensile strength, and abrasion resistance. The 7000 series of alloys (in the Aluminum Association classification scheme) is especially preferred to meet these criteria; the 6000 series may be employed with lower toner transfer pressures, as discussed below. The member is preferably fashioned to provide an even distribution of intermetallics at or near the surface, thereby reducing the risk of formation of surface pits and subsurface voids in the oxide layer during anodizing. It is beneficial for this reason, if possible, to form the member by extrusion. In the preferred embodiment of the invention, the member is comprised of a solid extruded cylinder. Alternatively the member may take the form of a cylindrical sleeve, which is fitted onto a conductive mandrel.

The surface of the aluminum member is machined preparatory to the second step of hardcoat anodizing, advantageously to provide a surface smoothness of better than 20 microinch rms. A preferred machining technique for this step is grinding, in order to avoid surface discontinuities which may lead to cracks during subsequent processing.

In the second processing stage, the machined aluminum member is hardcoat anodized according to the teachings of Wernick and Pinner; see *The Surface Treatment and Finishing of Aluminum and its Alloys* by S. Wernick and R. Pinner, fourth edition, 1972, published by Robert Draper Ltd., Paddington, England. The anodization is carried out to a desired surface thickness, typically of one to two mils. This results in a relatively porous surface layer of aluminum oxide characterized by the presence of a barrier layer isolating the porous oxide from the conductive aluminum substrate. Precautions should be taken and the parameters of anodization chosen to avoid gas ruptures in the anodic oxide layer which will result in surface pits and subsurface voids. It is also desirable to avoid branching of the pores, which will interfere with the crucial impregnation step as explained below. It is highly desirable, furthermore, to avoid contamination of the oxide layer, for example with oils and waxes. Following anodization, the member's surface is thoroughly rinsed in deionized water in order to remove all anodizing bath and other residual substances from the surface and the pores. The oxide surface may be further rinsed in isopropyl alcohol to effect partial removal of moisture from the pores, and may also be vapor rinsed for removal of grease and like contaminants. The rinsed surface is preferably wiped dry to reduce surface moisture.

After anodizing the member, and prior to impregnating of the pores with a sealing material, the method of the invention requires a thorough dehydration of the porous surface layer. For best results, the dehydration is accomplished immediately after anodization. If there is a long delay between these two steps, however, it is advisable to maintain the member in a moisture-free environment. This is done in pursuance of the general objective of avoiding a reaction with ambient moisture which leads to the formation of boehmite [$AlO(OH)_2$] at pore mouths, effectively partially sealing the porous oxide so that subsequent impregnation is incomplete and dielectric properties are degraded. Such partial sealing can occur at room temperature in normal ambient humidity in a period of several days.

Removal of absorbed water from the porous oxide layer of an anodized aluminum structure may be realized by using either heat, vacuum, or storage of the article in a desiccator. The dehydration step requires thorough removal of water from the pores. Although all three techniques are effective, best results are realized by heating, optionally while maintaining the member in a vacuum. A preliminary step of dehydrating the member in a vacuum oven is especially preferred where the member has been stored in a moist environment for a period after anodization. Heating of the member in air, as compared with vacuum heating, results in only a slightly lower level of charge acceptance. Any thermal treatment of the oxide layer prior to impregnation preferably is carried out at a temperature in the range from about 100° C. to about 180° C., most preferably in the range 150° C.–170° C. It is an advantageous characteristic of the impregnant waxes of the invention, discussed below, that they do not undergo marked degradative, physical and chemical changes at these temperatures. Preferably, preliminary heating is effected for a limited duration, to avoid a significant loss of tensile strength of the anodized member; such periods are characteristicably shorter for alloys of the 7000 series as compared with the 6000 series alloys. An illustrative period would be one hour or less for 7075-T6 alloy. Where precautions have been taken after anodizing to minimize the retention and accumulation of moisture, the dehydration step may be accomplished in conjunction with the impregnation step, as explained below.

After removal of absorbed water, the oxide coating is sealed with an impregnant material. In the present invention, the impregnant material consists essentially of a wax or compounded wax formulation having the requisite resistivity and other dielectric properties; favorable impregnation characteristics; and hydrophobicity. It is desirable to employ a material having low shrinkage during the cooling from the elevated impregnation temperature, typically on the order of 150° C., to ambient temperature, and having low moisture absorbance during and after impregnation. It has been found that particularly advantageous materials include carnauba wax and montan wax.

Carnauba wax, as a natural material, comes in various grades which have been found suitable in the present invention. Carnauba yellow no. 1 and refined nos. 2 and 3 have all been found to give the requisite charge acceptance, impregnation characteristics, and other properties. Carnauba yellow no. 1 is most preferred for reasons of purity. In the alternative embodiment, Montan wax is employed as the impregnant material. Any of the above waxes may be compounded with resins or other additives for enhanced dielectric and structural properties provided that they permit adequate impregnation.

In order to avoid introduction of moisture into the dehydrated porous surface layer, the member should be maintained in a substantially moisture-free state during impregnation. This will occur as a natural consequence of the preferred method of applying the impregnant materials of the invention. In the preferred embodiment of the invention, the member is preheated to an elevated temperature above the melting point of the impregnant wax, and maintained at or near this temperature during the impregnation step in order to melt the material or to avoid solidifying premelted material. These materials have sufficiently low viscosity after melting to impregnate the pores of the oxide surface layer. The period of heating the member from room temperature to the impregnating temperature may provide the preliminary dehydration which is required to avoid trapped moisture in the pores, often without a prior separate dehydrating step. (See Examples 1 and 2).

It has generally been found unnecessary to maintain the heated member in a vacuum during impregnation.

either to avoid absorption of moisture or to assist the impregnation of the pores through capillarity. In the preferred embodiment, the impregnant material may be applied to the oxide surface under moist ambient conditions because the heating of the aluminum member will tend to drive off any absorbed moisture from the oxide surface. Optionally, a vacuum may be employed in order to provide an extra precaution against reintroduction of moisture and to expedite impregnation. This may be contrasted to the fabrication process of Ser. No. 072,524, which requires special measures to protect against reintroduction of moisture during the impregnation stage.

In the preferred embodiment of the invention, the impregnant material is applied to the surface of the aluminum member after heating the member to a temperature above the melting point of the material. Advantageously, the impregnant wax is premelted and applied to the oxide surface in liquid form (as by brushing the material onto the member or immersing the member in melted material). In either case, the material should then be allowed to spread over the oxide surface layer. This may be done by permitting a flow of the melted material, or by manually spreading the material over the surface using a clean, dry implement. The member should be maintained at or near this elevated temperature for a period of time sufficient to allow the melted material to completely impregnate the pores of the oxide surface layer. This period will be shorter when using a vacuum to assist impregnation.

It has been determined that a complete impregnation of the pores is important in achieving desired charging and discharging characteristics of the dielectric surface. In the preferred embodiment, if the member is allowed to cool prior to complete filling of the pores with the impregnant material, the material will tend to solidify leaving undesirable air pockets in the pores. It is a particularly advantageous aspect of this method that this problem may be remedied simply by reheating the aluminum member and allowing a more complete filling of the pores. The impregnant wax compositions effectively adhere to the pore walls. The member may be reheated for a subsequent impregnation step at any time subsequent to the initial impregnation, but preferably prior to polishing, as the impregnant material of the invention is not cross-linked. As previously mentioned, it is desirable to avoid branching of the pores inasmuch as this will interfere with a complete sealing of the pores.

Subsequent to impregnation of the pores, the aluminum is allowed to cool. During this period the impregnant wax will tend to shrink only slightly. The member is then treated (as by wiping or scraping) to remove any excess material from the surface, leaving only the material in the pores. In order to provide a surface with good release properties for electrostatic toner, a preferred embodiment of the invention includes a final step of polishing the member's surface to a finish better than 20 microinch rms, preferably better than 10 microinch rms.

FIG. 1 gives a schematic view of an electrographic printing system according to U.S. Pat. No. 4,267,556, incorporating a dielectric imaging cylinder in accordance with the invention. The printer 10 is formed by two metallic rollers 1 and 11. The upper roller, fabricated by the method described above, includes a hard dielectric surface layer 3 and a conducting core 5, while the lower roller 11 has a compliant layer of engineering thermoplastic material 13 over a metallic core 15. A latent electrostatic image in the pattern of an imprint that is to be made is provided on the dielectric layer 3 by charging head 20. The latent image is then toned, for example by charged, colored particulate matter, at a station 30, following which the toned image undergoes essentially total pressure transfer with simultaneous room temperature fusing to a receptor sheet 9, to form the desired imprint. No heat or electrostatic aid is utilized in the image transfer/fusing process. The electrostatic printer of FIG. 1 desirably includes a scraper blade 17 and a unit 40 for erasing any latent residual electrostatic image that remains on the dielectric layer 3 before reimaging takes place at the charging head 20.

Applicants have observed that the skewing of rollers 1 and 11 at an angle on the order of one degree relative to an axial center point achieves marked improvements in the toner transfer and fusing process. The principal advantage is an unexpected, dramatic improvement in toner transfer efficiency, which is reflected in a reduction of residual toner on roller 1 by a factor of one hundred or more. The skewing of rollers 1 and 11 also is seen to provide a greater uniformity of load distribution, and thereby achieves improved image fusing.

The dielectric layer 3 advantageously is capable of accepting a latent electrostatic image of relatively high potential. In general, a thicker dielectric layer will possess a higher charge acceptance. As a related matter, the surface layer 3 should have a high dielectric strength. The invention provides a simple and reliable technique for fabricating aluminum oxide layers of a thickness as great as 100 microns and capable of supporting several thousand volts. Advantageously, the oxide layer 3 has a thickness in the range $12\mu$–$100\mu$, more preferably $20\mu$–$35\mu$. It is desirable for the dielectric surface layer 3 to have sufficiently high resistivity to support a latent electrostatic image during the period between latent image formation and toning. Consequently, the resistivity of the layer 3 should be in excess of $10^{12}$ ohm-cm. The surface of the layer 3 should be hard and relatively smooth, in order to provide for complete transfer of toner to the receptor sheet 9. The dielectric layer 3 additionally should have a high modulus of elasticity so that it is not distorted by high pressures in the transfer nip. Such pressures advantageously are sufficiently high to effect simultaneous transfer and fusing of the toner image. In order to provide a high service life it is desirable that layer 3 have high tensile strength and abrasion resistance. A dielectric cylinder produced in the manner described above satisfies all these requirements. A further characteristic of some importance in this application is the provision of a continuous surface, with minimal surface pitting, cracks, and other discontinuities. Such discontinuities will entrap toner particles, and cause severe wear in the scraper blades and cylinder surface.

It is furthermore desirable to reduce "dielectric absorption", or the tendency of the dielectric layer 3 to hold a charge below its surface. Subsurface charge will migrate to the surface after neutralizing at station 40 (FIG. 1)—a highly undesirable phenomenon. Dielectric absorption is generally aggravated by inadequate preliminary dehydration; poor, incomplete impregnation; decomposition of the impregnant material; formation of boehmite in the pores during the period after anodizing; or introduction of moisture during impregnation. The various processing steps of the invention are advantageously implemented to reduce dielectric absorption.

There is a tendency, as well, for worsening of this characteristic if the finished dielectric member is stored or operated in high relative humidities. The impregnant materials of the invention have been found to provide dramatic improvements in discharging characteristics at high relative humidities.

The advantages of these methods and products will be further apparent from the following non-limiting examples:

EXAMPLE 1

A hollow aluminum cylinder of extruded 7075-T651 alloy was machined to an outer diameter of 4 inches and 9 inches in length, with 0.75 inch wall thickness. The cylinder was machined to a 30 microinch finish, then polished to a 2.25 microinch finish. The cylinder was hardcoat anodized by the Sanford "Plus" process to a thickness between 42 and 52 microns, then rinsed successively in deionized water, isopropyl alcohol, and a freon rinse for grease removal.

The cylinder was then placed for 30 minutes in a vacuum oven at 30 inches mercury, 160° C. The cylinder was maintained at this temperature and pressure for half an hour prior to impregnation.

A beaker of Carnauba Yellow No. 1 wax was preheated to 100° C. to melt the wax. The heated cylinder was removed from the oven, and coated within 10 seconds with the melted carnauba wax using a paint brush. The cylinder was then placed back in the vacuum oven for a few minutes at 160° C., 30 inches mercury. The cylinder was removed from the oven and allowed to cool.

After cooling, the member was polished with successively finer SiC abrasive papers and oil. Finally, the member was lapped to a 4.5 microinch finish by application of a lapping compound and oil with a cloth lap.

The cylinder's charge acceptance was measured at 980 volts using a Monroe Electronics electrostatic voltmeter, manufactured by Monroe Electronics, Middleport, NY. The cylinder was charged to 280–290 volts and then discharged using corona charging apparatus of the type described in the commonly assigned U.S. Ser. No. 237,559 filed Feb. 24, 1981. The corona device was grounded to the aluminum core 34 of cylinder 32. The cylinder showed a residual surface charge of 4–5 volts, indicating outstandingly low dielectric absorption.

EXAMPLE 2

A dielectric cylinder was fabricated in accordance with Example 1, with the modification that the pores of the aluminum oxide surface layer were impregnated with Carnauba Yellow No. 2 wax. The cylinder exhibited comparable charge acceptance and dielectric absorption using the testing method of Example 1.

EXAMPLE 3

A dielectric cylinder fabricated in accordance with Example 1 was incorporated in an electrographic printer of the type described with reference to FIG. 1. Referring to this figure, the pressure roller 11 consisted of a solid machined two inch diameter aluminum core 15 over which was press fit a two inch inner diameter, 2.5 inch outer diameter polysulfone sleeve 13. The dielectric roller 1 was gear driven from an AC motor to provide a surface speed of 12 inches per second. The pressure roller 11 was held against the dielectric cylinder with a nip pressure of 300 pounds per linear inch of contact. Rollers 1 and 11 were mounted with an end-to-end skew of 1.1°.

A charging head or cartridge 20 of the type described in commonly assigned U.S. Pat. No. 4,160,257 was used to generate latent electrostatic images. The charging head was maintained at a spacing of 8 mils from the surface of the dielectric cylinder 1.

Under these conditions it was found that a 300 volt latent electrostatic image was produced on the dielectric cylinder in the form of discrete dots. The image was toned using single component toner from the toning feeder mechanism 30 which was essentially identical to that employed in the Develop KG Dr. Eisbein and Company (Stuttegart) No. 444 copier. The toner employed was Hunt 1186 of the Phillip A. Hunt Chemical Corporation. The receptor 9 was plain paper injected into the pressure nip at the appropriate time from a sheet feeder.

Engineering plastic scraper blades were employed in the scraper assembly 17 to remove excess toner from the surface of the dielectric cylinder 1. The residual latent electrostatic image was erased using a corona charging/discharge device 40 in accordance with commonly assigned U.S. application Ser. No. 237,559 filed Feb. 24, 1970. After neutralization, a residual electrostatic image on the order of 4–5 volts remained on dielectric surface 3, allowing reimaging by the cartridge 20 with negligible ghost imaging.

No image fusing was required other than that occurring during pressure transfer. The transfer efficiency (i.e. percentage of toner transferred from the cylinder 1 to plain paper 9) was 99.9 percent.

The dielectric cylinder provided a service life of over one million copies.

EXAMPLE 4

Figure 10:
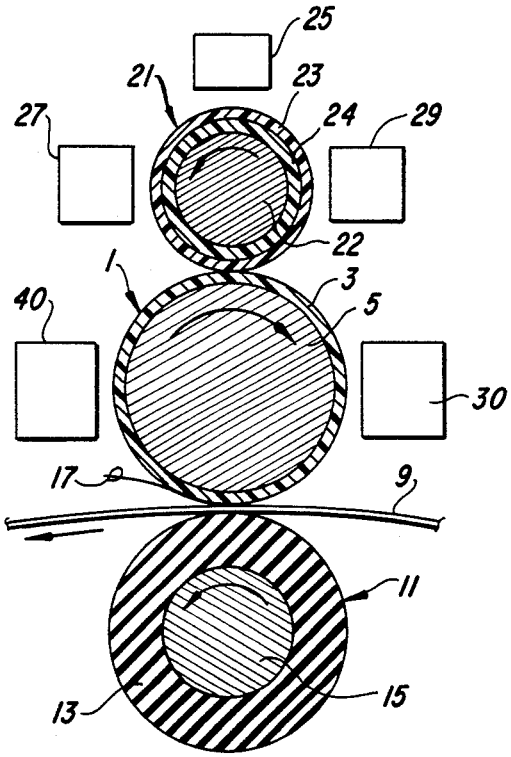
FIG. 10 shows a sectional schematic view of a double transfer electrophotographic apparatus.

A dielectric cylinder fabricated in accordance with Example 1 was incorporated in double transfer electrophotographic apparatus of the type disclosed in U.S. Pat. No. 4,195,927. This is represented schematically by FIG. 10, wherein the charging head 20 of FIG. 1 is replaced with a photoconductor 21 (including a conductive core 22, photoconductive surface layer 23, and a semiconductive interlayer 24 as disclosed in commonly assigned U.S. Pat. No. 4,282,297). The apparatus also included charging station 25, optical exposure apparatus 27, and an erase lamp 29.

The pressure roller 11 consisted of a solid machined 2-inch diameter core 15 over which was press fit a 2-inch inner diameter, 2.5-inch outer diameter polysulfone sleeve 13.

The conducting substrate 22 of photoconductor member 21 comprising an aluminum sleeve, was fabricated of 6061 aluminum tubing with a $\frac{1}{8}$ of an inch wall and a 2-inch outer diameter. The outer surface was machined and the aluminum anodized (using the Sanford process) to a thickness of 50 microns. In order to provide the proper level of oxide layer conductivity, nickel sulfide was precipitated in the oxide pores by dipping the anodized sleeve in a solution of nickel acetate (50 g/L, pH of 6) for 3 minutes. To form the semiconducting layer 24, the sleeve was then immediately immersed in concentrated sodium sulfide for 2 minutes and then rinsed in distilled water. This procedure was repeated three times. The impregnated anodic layer was then sealed in water (92° C. pH 5.6) for ten minutes. The semiconducting substrate 24 was spray-coated with a binder layer photoconductor 23 consisting of photoconductor grade cadmium sulfo-selenide powder milled with a heatset DeSoto Chemical Co. acrylic resin, diluted with methyl ethyl ketone to a viscosity suitable for spraying. The dry coating thickness was 40 microns, and the cadmium pigment concentration in the resin binder was 18 percent by volume. The resin was cross-linked by firing at 180° C. for three hours.

The dielectric cylinder 1 was gear driven from an AC motor to provide surface speed of eight inches per second. The pressure roller 11 was mounted on pivoted and spring loaded side frames, causing it to press against the dielectric cylinder 1 with a pressure of 300 pounds per linear inch of contact. Rollers 1 and 11 were mounted with an end-to-end skew of 1.1°.

Strips of 1 mil tape ($\frac{1}{8}$ inch wide) were placed around the circumference of the photoconductor sleeve 21 at each end in order to space the photoconductor at a small interval from the oxide surface of the dielectric cylinder 1. The photoconductor sleeve was freely mounted in bearings and friction driven by the tape which rested on the oxide surface.

A single component latent image timing system 30 and optical exposing apparatus 27 were essentially identical to those employed in the Develbp KG Dr. Eisbein & Co., (Stuttgart) No. 444 copier. Photoconductor charging corona 25, and a device 40 for neutralizing the residual latent image on cylinder 1, were of the general type disclosed in commonly assigned U.S. application No. Ser. No. 237,559. The charging corona 25 was biased to minus 1000 volts relative to the photoconductor core 22, while the erase device 40 was grounded to the core 5 of image cylinder 1. Engineering plastic scraper blades 17 were employed to maintain cleanliness of dielectric surface 3.

A DC power supply was employed to bias the photoconductor sleeve 22 to a potential of minus 400 volts relative to the dielectric cylinder core 5, which was maintained at ground potential. An optical exposure of 25 lux-seconds was employed in discharging the photoconductor in high-light areas. In undischarged areas, a latent image of minus 400 volts was transferred to the oxide dielectric 3. This image was toned, and then transferred to plain paper 9 which was injected into the pressure nip, at the appropriate time, from a sheet feeder.

Copies were obtained at a rate of 30 per minute, having clean background, dense black images, and resolution in excess of twelve line pairs per millimeter. No image fusing, other than that occurring during pressure transfer, was required. The dielectric cylinder 1 provided a service life of over one million copies.

EXAMPLES 5-7

The following examples were performed to demonstrate the electrical qualities of dielectric members produced according to the above-disclosed technique using different impregnants. A series of 2 inch×2 inch×0.8 inch coupons fabricated of 7075T6 aluminum alloy sheet stock were cut down to 1"×1" after impregnation to polish and test. The samples were anodized using the Sanford Plus process, rinsed with tap water, then heated five minutes on a 160°-175°F. laboratory hot plate for dehydration. The impregnants were melted onto the samples and the coupons were left on the hot plate for an additional minute. Excess impregnant was wiped off the coupons before solidifying, and the coupons were polished using a Buehler Minimet polishing/grinder unit, (Buehler, Ltd., Lake Bluff, Illinois) with successive 300, 400, and 600 grit dry disks.

Figure 2:
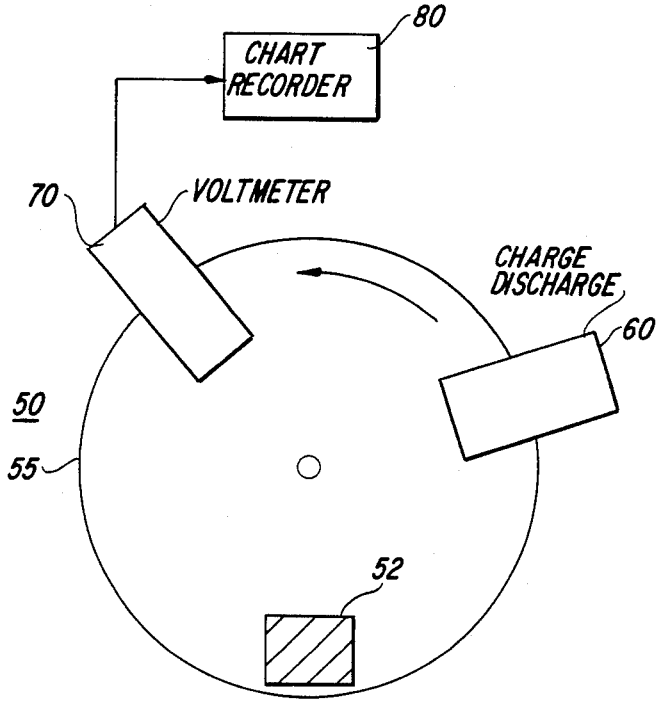
FIG. 2 is a schematic plan view of electrostatic testing apparatus for dielectric members.
Figure 3:
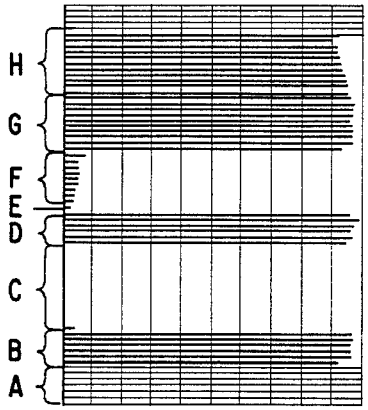
FIGS. 3–9 are time plots of surface potential for dielectric coupons tested in the apparatus of FIG. 2, for various wax impregnants.
Figure 4:
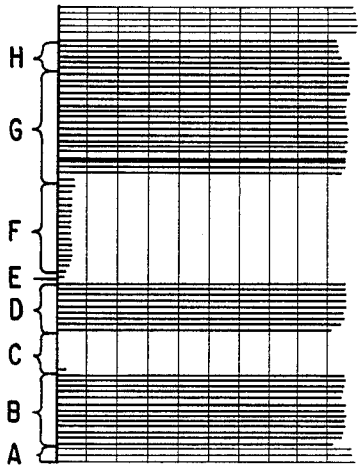
Figure 5:
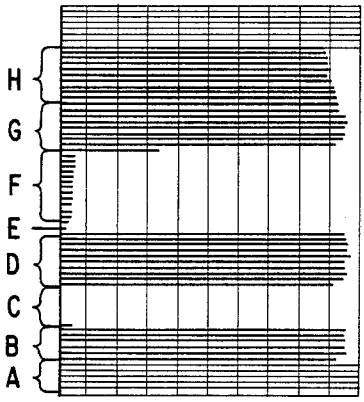
Figure 6:
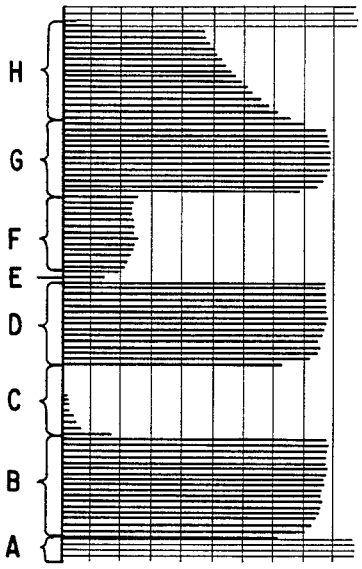
Figure 7:
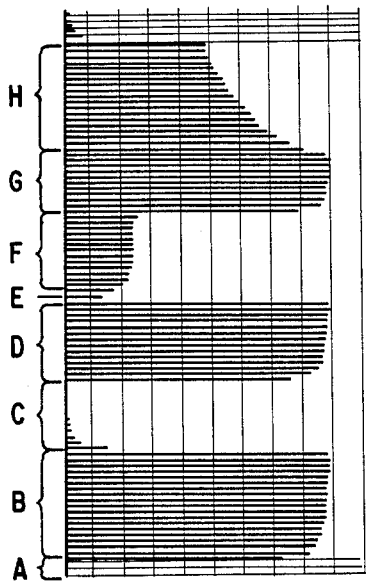
Figure 8:
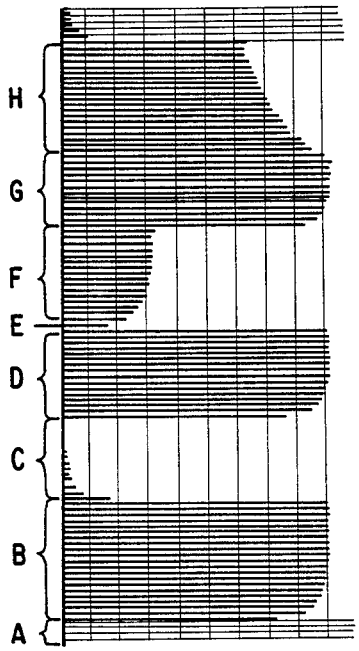

The charging and discharging characteristics of the finished samples were tested using apparatus 50 schematically illustrated in FIG. 2. The coupon 52 to be tested was mounted, anodized face upward, on a turntable 55 where the coupon would move at a surface speed of 10 inches per second as the turntable rotated. The conductive aluminum substrate of coupon 52 was grounded to the turntable 55. Once each cycle the sample was passed under an electrostatic charging/discharging device 60 of the type disclosed in commonly assigned U.S. application Ser. No. 237,559. The device 60 was selectively set to a 225-250 volt bias for charging, to ground for discharging, or disconnected. The potential of coupon 52 was measured using a Monroe electrostatic voltmeter 78 (Monroe Electronics, Middleport, N.Y.) with a probe spaced 0.1 inch from the dielectric surface of coupon 52. The readings from voltmeter 70 were recorded on a Gould chart recorder 80 (Gould Inc., Instruments Div., Cleveland, Ohio). This recorder produced charts shown in FIGS. 3 to 9 using a time division of 0.5 mm/second on the vertical scale (on which the readings proceed from bottom to top) and 25 volts/major division on the horizontal scale. Therefore, each horizontal line making up the charts represents the voltage reading for a given cycle.

With reference to the chart recordings of FIGS. 3-9, the test apparatus was operated with the following charging/discharging sequences identified by lettering corresponding to those used in the Figs.:

A. Repeated discharge
B. Repeated charge
C. Repeated discharge
D. Repeated charge
E. One discharge
F. Charging device disconnected
G. Repeated charge
H. Charging device disconnected The period F, which indicates the voltage profile after a single neutralization cycle, gives a measure of dielectric absorption. It is an important index of successful dielectric fabrication to achieve low potential readings during this period. The readings during period H give a measure of the charge decay characteristics ("self-decay").

EXAMPLE 5

The testing apparatus 50 discussed above with reference to FIG. 2 was used to record voltage readings taken from a series of coupons 52 fabricated as described above. The coupons were tested immediately after polishing, in a 18% R.H., 74° F. laboratory environment. The coupons were impregnated with Carnauba yellow no. 1, Carnauba yellow no. 2, and crude montan waxes and the chart recordings are reproduced in FIGS. 3, 4, and 5 respectively.

The samples all exhibited excellent charge acceptance and outstandingly low dielectric absorption.

EXAMPLE 6

The tests of Example 5 were repeated with the following modification. The sample coupons were stored for 17 hours in a dessicator at 95% R.H., 74° F. The samples were tested immediately after removal from the dessicator. The resulting charts for Carnauba yellow no. 1, Carnauba yellow no. 2, and montan waxes are reproduced respectively in FIGS. 6, 7, and 8. Again, the samples all exhibited excellent charge acceptance and low dielectric absorption, the latter being somewhat higher than recorded for the samples of Example 5. The carnauba wax samples were found to give somewhat superior readings to those for crude montan wax.

EXAMPLE 7

Tests of the above-described type were conducted for a variety of impregnant waxes, including beeswax, candelilla wax, 180/185 microcrystalline wax, 170/175 microcrystalline wax, superla wax, 125/130 paraffin, and 160/165 paraffin (the various numerals indicate a range of melting points). The beeswax and candelilla wax samples were tested after polishing and 66 hours storage in an 85% R.H., 74° F. desiccator. The remaining samples were tested shortly after cooling and removal of excess wax.

Figure 9:
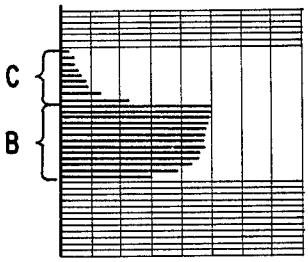

FIG. 9 shows a reading taken during the periods B and C: repeated charging and repeated discharge, for beeswax. The remaining charts (not shown) were similar in their voltage profiles. These readings indicated poor dielectric properties for beeswax and candelilla wax after exposure to high relative humidities, while the remaining impregnants gave unacceptable results even before polishing.

While various aspects of the invention have been set forth in the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims. Dielectric cylinders manufactured according to the techniques of the invention have been disclosed in combination with particular electrographic printing and electrophotographic apparatus, but dielectric members manufactured in accordance with the invention may be utilized in a wide variety of electrostatic imaging systems not discussed herein.

We claim:

1. A method of treating a member to form a dielectric surface layer, comprising the steps of:

hardcoat anodizing the member, which is comprised of a material selected from the group consisting of aluminum and aluminum alloys, to form an oxide surface layer having a plurality of pores and a barrier layer, heating the aluminum member to an elevated temperature in the range of 120°–180° C., impregnating the pores of the oxide surface layer with a material selected from the group consisting of carnauba wax, montan wax, and compounds of said waxes while the member is at a temperature above the melting point of the impregnating wax, to form a dielectric surface layer with a resistivity in excess of $10^{12}$ ohm-centimeters, and removing any of the wax on the exterior of the dielectric surface layer.

2. The method of claim 1, further comprising the step of polishing the dielectric surface layer to a finish better than 20 microinch r.m.s.

3. The method of claim 1, wherein the impregnating material is selected from the group consisting of carnauba No. 1 yellow wax, carnauba No. 2 refined wax, carnauba No. 3 refined wax, and crude montan wax.

4. The method of claim 1, wherein the heating step is effexted in a vacuum.

5. The method of claim 1 wherein the member to be anodized is comprised of an aluminum alloy selected from the 6000 and 7000 series alloys of the Aluminum Association.

6. The method of claim 1, wherein the member to be hardcoat anodized is formed by extrusion.

7. A method of treating a member to form a dielectric surface layer, comprising the steps of:

fabricating a member by extrusion from a material selected from the group consisting of aluminum and aluminum alloys, hardcoat anodizing the member to form an oxide surface layer having a plurality of pores and a barrier layer, dehydrating the oxide surface layer to thoroughly remove water form the pores, heating the pores of the oxide surface layer to thoroughly remove water from the pores, impregnating the pores of the oxide surface layer with a material selected from the group consisting of carnauba wax, montan wax, and compounds of said waxes, while heating the layer to a temperature above the melting point of said wax, to form a dielectric surface layer with a resistivity in excess of $10^{12}$ ohm-centimeters, and removing any of the wax on the exterior of dielectric surface layer.

8. The method of claim 7, further comprising the step of polishing the dielectric surface layer to a finish better than 20 microinch r.m.s.

9. The method of claim 7, wherein the dehydrating step comprises heating the anodized aluminum member to a temperature in the range from 120°–180° C.

10. The method of claim 7, wherein the impregnating wax is applied to the oxide surface layer as a hot melt, while maintaining the surface at a temperature above the melting point of said wax.

11. The method of claim 7, wherein the impregnating material is selected from the group consisting of carnauba No. 1 yellow wax, carnauba No. 2 refined wax, carnauba No. 3 refined wax, and crude montan wax.

* * * * *